United States Patent [19]

Kuromitsu et al.

[11] 4,400,602

[45] Aug. 23, 1983

[54] FLUID PRESSURE OPERATED ELECTRICAL SWITCH

[75] Inventors: Hiromu Kuromitsu, Chiryu; Yoshiharu Adachi, Gamagori, both of Japan

[73] Assignee: Aisin Seiki Kabushiki Kaisha, Aichi, Japan

[21] Appl. No.: 250,550

[22] Filed: Apr. 3, 1981

[30] Foreign Application Priority Data

Apr. 16, 1980 [JP] Japan ..... 55-50764
Apr. 23, 1980 [JP] Japan ..... 55-53774

[51] Int. Cl.[3] ..... H01H 35/38

[52] U.S. Cl. ..... 200/82 C; 200/83 J; 200/83 Q

[58] Field of Search ..... 200/81 R, 82 R, 82 C, 200/83 J, 83 Q, 83 W

[56] References Cited

U.S. PATENT DOCUMENTS 2,736,778 2/1956 Buchanan ..... 200/82 C
3,261,958 7/1966 Bittner ..... 200/82 C
3,444,341 5/1969 Mighton ..... 200/82 C
4,225,760 9/1980 Griffith ..... 200/82 C

*Primary Examiner*—G. P. Tolin
*Attorney, Agent, or Firm*—Oblon, Fisher, Spivak, McClelland & Maier

[57] ABSTRACT

A fluid pressure operated electrical switch has a piston element subject to an operating fluid pressure on its acting end face for actuating an electrical switch. The switch employs a limiting member for limiting motion of the piston element to a predetermined extent in order to prevent the switch from being damaged due to overstroke of the piston element. The limiting member includes a flange at the rearmost end of the piston element and an annular shoulder in a bushing which is closely fitted within a port of a switch body for the operating fluid pressure. The piston element is loosely fit in the bushing with the flange in engagement within the shoulder of the bushing such that the flange and shoulder cooperate to provide limitation of the stroke of the piston element.

5 Claims, 6 Drawing Figures

FLUID PRESSURE OPERATED ELECTRICAL SWITCH

BACKGROUND OF THE INVENTION

1. Field of the Invention

This invention relates to fluid pressure operated electrical switches, responsive to a predetermined range of pressure from a hydraulic system, or in any particular branch or part of said system.

2. Description of the Prior Art

It has been proposed in fluid pressure operated electrical switches to provide a piston element responsive to the fluid pressure to actuate the switch with a limitation of the stroke to a predetermined extent by employing a stopper member for the piston in front of the piston element for avoiding damage of the switch due to overstroking. Such arrangement is usually relatively complicated and installation is accordingly complicated. Further, the conventional switches have sealing means for sealing the piston element and which is normally exposed to operating fluid pressure. This tends to result to a short life span of the sealing means.

Still further, the conventional switches are provided with a spring to restore the piston element against the operating fluid pressure and an adjusting member to adjust the spring force of the spring in order to provide a proper responsiveness of the piston element to the operating pressure. Such adjusting member is customarily disposed outside the convenient reach of the operator.

SUMMARY OF THE INVENTION

An important object of the present invention is to provide a novel type of pressure operated electrical switch, wherein a pressure operated piston element is provided with means to limit motion of the piston element adjacent its rearmost end and an adjusting member is provided within convenient reach of the operator.

A further object is to provide the motion limiting means with a valve mechanism for isolating the interior of the switch from the operating fluid pressure when the piston element is moved through a predetermined distance for actuating the switch member.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 1:
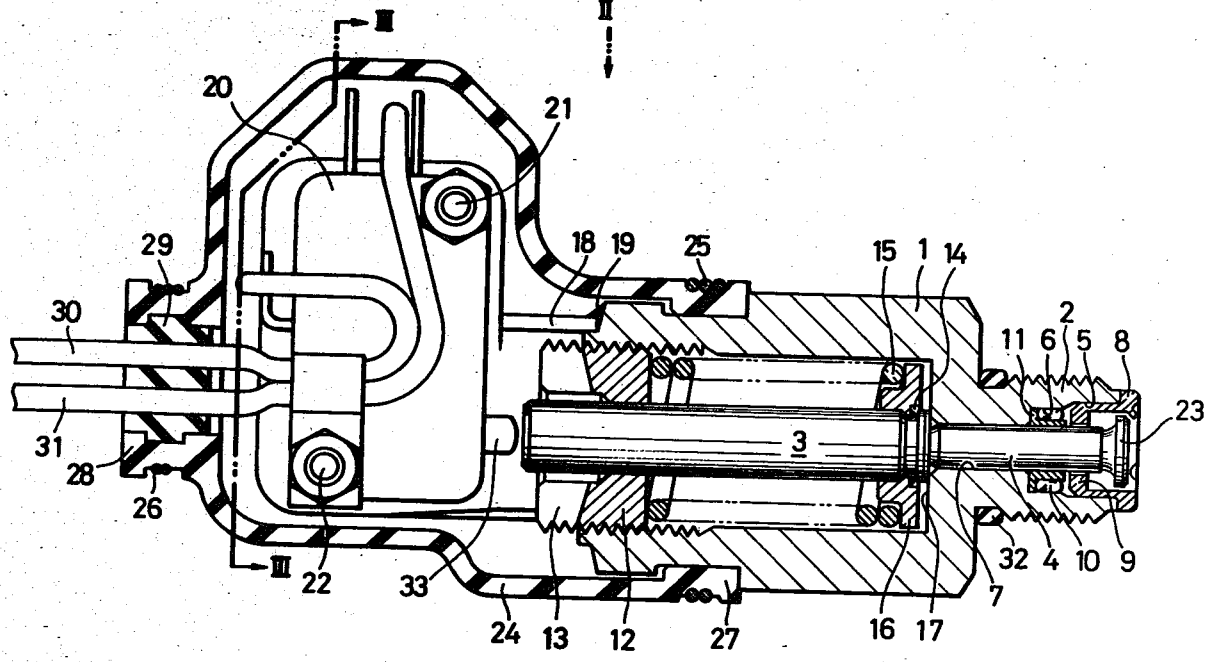
FIG. 1 is a vertical sectional view showing a first embodiment of the present invention.

Referring now to FIG. 1, a pressure operated switch according to the invention comprises a body 1 in which is slidably mounted a plunger 3 so as to be movable by means of pistion element 4 in accordance with operating pressure that may be applied to element 4 on a predetermined selected area that defines an effective working area, as described in greater detail hereinafter.

The body 1 is provided with an externally threaded port or entrance 2 for connection to either a hydraulic or a pneumatic pressure system or any desired branch or section thereof. This port has a central bore 5 extending into a stepped middle bore 6 which in turn extends into a smallest diameter bore 7. Into the entrance or the central bore 5 is force-fitted or screwed a limiting bushing 8 having an annular shoulder 9 to be described in detail later. In the middle bore 6 are disposed a rubber O-ring 10 and a back-up ring 11 of plastic material in which the piston element 4 is slidingly and sealingly fitted. Fluid leakage past piston element 4 is prevented so that undesired counterpressure does not build up on piston element 4 and no fluid leaks occur which are communicated to a switch member 20 to be described hereinbelow.

The plunger 3 is slidingly fitted within an adjusting member 12 externally threaded for screwing engagement with an internally correspondingly threaded bore of the body 1. The adjusting member 12 is provided with a suitable number of axial grooves 13 in its circular wall for cooperative engagement with a driver tool and the like in adjusting rotation of the member 12. A spring retainer 16 is locked on the plunger 3 preferably by ring 14. A compressed restoring spring 15 is interposed between the adjusting member 12 and the retainer 16 for normally urging plunger 3 against piston element 4. Plunger 3 therefore becomes restrained against shoulder 17 and stays there until the acting pressure increases to a predetermined value as will be further discussed later.

A switch sustainer bracket 18 is welded as shown at 19 to the body 1. A switch or suitable snap-action electrical switch 20 is bolted by means of bolts 21 and 22 to the bracket 18. This switch 20 may have any desired number of contact that are either normally closed or normally open, as the circumstance of the intended application may require. Such switches are well known and require no further description for a person skilled in this art. The body 1 carries the bushing 8 as aforementioned at the entrance 2 for stopping the element 4. Bushing 8 has its shoulder 9 positioned so as to be engageable with the flange 23 of piston element 4 such that motion of the piston element 4 is limited by abutment of the flange 23 against the shoulder 9.

Body 1 is provided with a removable cover 24 of rubber sealed to the body by means of wires 25 and 26 at its beads 27 and 28. Bead 28 holds a socket 29 through which lead wires 30 and 31 lead to an electrical supply source (not shown). The external thread of port 2 is sealingly connected to the hydraulic or a pneumatic pressure system or any desired branch or section thereof by means of a seal ring 32.

Figure 2:
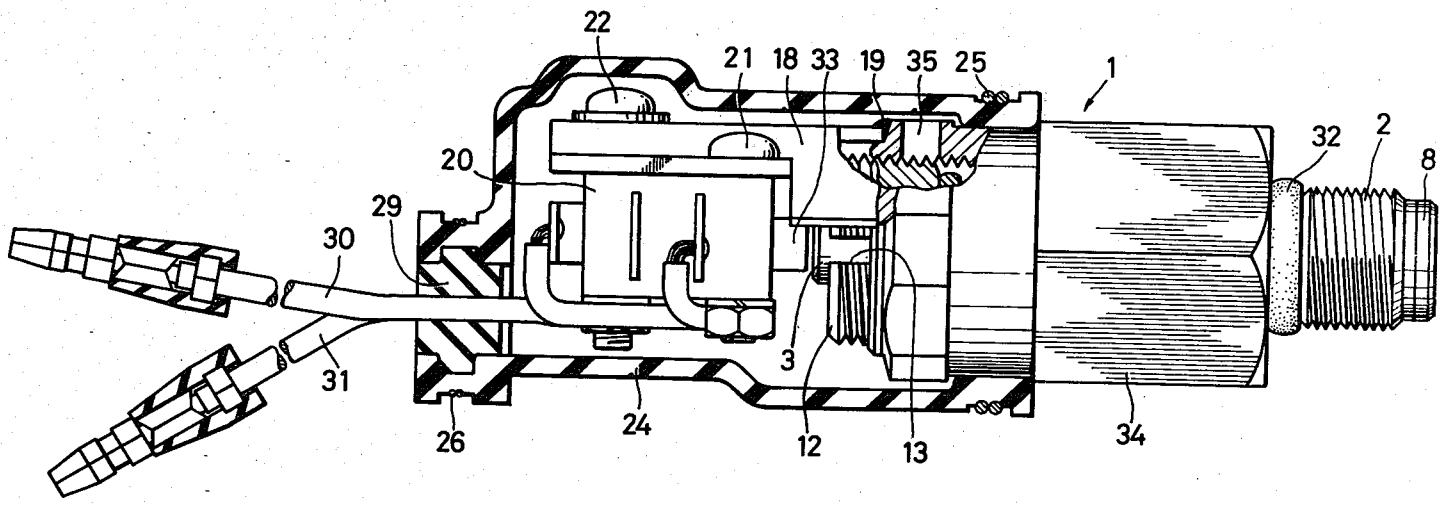
FIG. 2 is another vertical sectional view taken in the direction of arrow II in FIG. 1.
Figure 3:
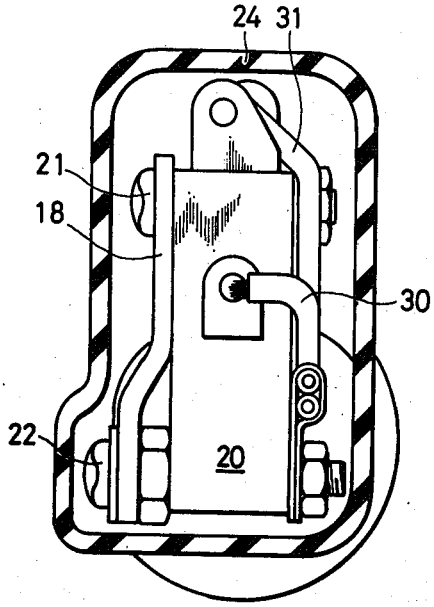
FIG. 3 is a cross sectional view taken along line III—III in FIG. 1.

With reference to the switch 20, actuating pin 33 is carried thereby for abutment engagement with plunger 3 as shown in FIG. 1. The body 1 is provided with a hexagonal shaped portion 34 (FIG. 2) enabling the body 1 to be readily inserted in a threaded hole. As shown in FIG. 2, body 1 has further at a middle portion thereof a hole 35 for ventilation of the interior of the body 1.

Acting pressure applied via port 2 acts upon the calibrated area of piston element 4 in bore 7 and pushes piston element 4 and hence flange 23 against shoulder 9 of bushing 8 where element 4 is held as the pressure increases and continues until the pressure applied via port 2 drops to a lower value. During the period in which the piston element 4 is held in abutment with shoulder 9, the switch member 20 is continuously actuated through plunger 3 and actuating pin 33. The stoppage and hence limitation of motion of element 4 is effective to prevent switch member 20 from being damaged due to an overstroking of the piston 4 and hence plunger 3.

Figure 4:
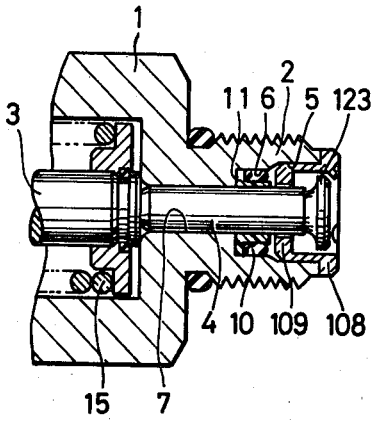
FIG. 4 is a view similar to that of FIG. 3 of a part of FIG. 1 modified for providing a valve mechanism to close the interior of the switch from the operating pressure.

A modification of FIG. 4 is intended to limit motion of piston element 4 while closing O-ring 10 and back-up ring 11 from a predetermined range of the operating pressure applied via bushing 8. This is attained by forming the flange 123 into a valve member and the shoulder 109 into an annular seat for cooperation with the valve member 123. The closure from the predetermined range of the operating pressure is effective to attain a longer service life of the O-ring 10 and the back-up ring 11. This may be attributed to the fact that the predetermined range is of higher value than is applied to the element 4 until the pressure reaches to the predetermined range at the port 2.

Figure 5:
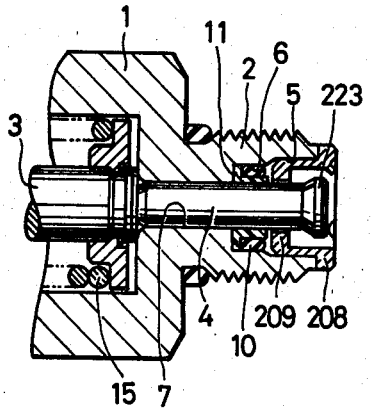
FIG. 5 is a view similar to that of FIG. 4 but showing another embodiment.

Another modification shown in FIG. 5 has a similar overall construction as that of FIG. 4 but has a conical valve face on the flange 223 while the seat 209 is an annular right edge type seat so that resultant valve mechanism is adapted to serve as a high pressure service.

Figure 6:
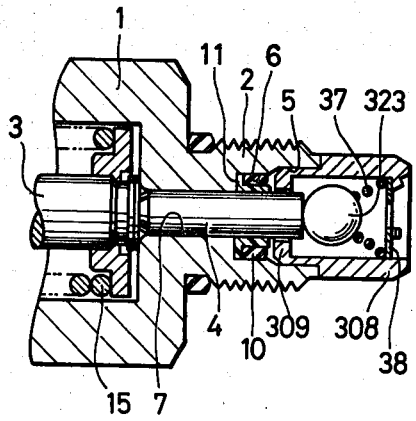
FIG. 6 is view similar to that of FIG. 4 but showing yet another embodiment.

Another modification shown in FIG. 6 has a cage 308 mounted in the port or in the central bore 5 such as by press fitting. The cage 308 has a ball 323 captive therein and a compressed spring between the ball 323 and a ring 38 engaging a corresponding annular shoulder in cage 308. The ball 323 is normally spring urged toward abutment against the piston element 4 and sealing engagement with an annular shoulder 309 as a seat for cooperation with the ball to form valve mechanism. Similar operation to that of FIG. 5 is performed by the modification.

Obviously numerous modifications and variations of the present invention are possible in light of the above teachings. It is therefore to be understood that within the scope of the appended claims, the invention may be practiced otherwise than as specifically described herein.

What is claimed is as follows:

1. A fluid pressure operated switch comprising:

a hollow body;

an electrical switch member operatively associated with the body;

a plunger slidingly mounted in the body;

switch engaging means carried by the switch member for operative engagement with the plunger at a front end portion of the plunger;

a piston element slidingly mounted in the body in alignment with and engaging a rear end portion of the plunger;

a compressed coil spring operatively associated with said rear end portion of the plunger for normally biasing the plunger toward abutting engagement with the front end portion of the piston element;

sealing means mounted on the piston element for sealing the piston element within the body, said body having a port formed therein for admitting fluid under pressure and to which the piston element is exposed at an acting rear end face portion thereof;

means for limiting motion of the piston element adjacent said rear end face portion of the piston element; and adjusting means in screw threaded engagement with the body for movably anchoring the coil spring at an end portion thereof adjacent said front end portion of the plunger wherein said means for limiting motion of the piston element further comprises a cage mounted in the port and having an internally extending annular seat disposed around the piston element, a ball movably housed in the cage, and a spring member for urging said ball toward engagement with said annular seat and toward abutment against the rear end portion of the piston element.

2. A fluid pressure operated switch as set forth in claim 1, wherein said sealing means further comprises an O-ring member of rubber material and a back-up ring of synthetic resin material having a cylindrical portion slidingly and sealingly fitted on the piston element and a radially outwardly extending flange portion extending from the cylindrical portion, said O-ring being disposed around the cylindrical portion for sealing the piston element in the body.

3. A fluid pressure operated switch as set forth in claim 1, wherein the port has a central bore extending into a smaller diameter middle bore, said middle bore further extending into a still further smaller diameter, innermost bore, said means for limiting motion of the piston element being closely fitted within the central bore, and wherein said sealing means for limiting motion of the piston element is disposed in the middle bore, said piston element being slidingly fitted within said innermost bore.

4. A fluid pressure operated switch as set forth in claim 1, wherein said means for limiting motion of the piston element further comprises an annular plate and wherein said spring member is positioned between said annular plate and said ball.

5. A fluid pressure operated switch as set forth in claim 1, wherein said hollow body further comprises a bracket secured to one end portion of the body or mounting said switch member outside said body and a cover member mounted to said body for covering said switch member and wherein said adjusting means is threadedly engaged with an open end portion of the body and which further comprises an end portion extending outwardly from said body, said end portion having a groove formed therein for cooperative engagement with an adjusting tool for adjusting the position of said adjusting means.

* * * * *